US007019602B2

(12) United States Patent
Engelhardt, Jr. et al.

(10) Patent No.: US 7,019,602 B2
(45) Date of Patent: Mar. 28, 2006

(54) HIGH ISOLATION RF SWITCH

(75) Inventors: Robert J. Engelhardt, Jr., Hillsboro, OR (US); Marc A. Gessford, Portland, OR (US); Kelly F. Cushing, Portland, OR (US); John M. Dunn, Portland, OR (US)

(73) Assignee: Tektronix, Inc., Beaverton, OR (US)

( * ) Notice: Subject to any disclaimer, the term of this patent is extended or adjusted under 35 U.S.C. 154(b) by 50 days.

(21) Appl. No.: 10/883,371

(22) Filed: Jun. 30, 2004

(65) Prior Publication Data

US 2006/0001510 A1 Jan. 5, 2006

(51) Int. Cl.
*H01P 1/10* (2006.01)

(52) U.S. Cl. ..... 333/105; 333/262
(58) Field of Classification Search ..... 333/105, 333/258, 262; 335/4, 5

See application file for complete search history.

(56) References Cited

U.S. PATENT DOCUMENTS 6,133,812 A * 10/2000 Magda ..... 335/4
6,727,778 B1 * 4/2004 Kudrle et al. ..... 333/33

* cited by examiner

*Primary Examiner*—Ramon M. Barrera
(74) *Attorney, Agent, or Firm*—Francis I. Gray

(57) ABSTRACT

A high isolation RF switch for launching a selected one of two RF signals into a slabline transmission line structure has a three switch configuration—a pair of input switches coupled to corresponding input ports and a transition switch coupled to an output port via a slabline transmission line. The input switches select one of the input ports for coupling to the transition switch, and the transition switch couples the selected input port from the input switches to the output port. A grounded conductor is situated between the input ports in a cavity of a housing within which the high isolation RF switch is located to provide isolation between the input ports. Additional isolation between the input ports is provided by coupling the non-selected RF signal to ground, either by grounding the non-selected input to the transition switch or the non-selected input port.

9 Claims, 7 Drawing Sheets

HIGH ISOLATION RF SWITCH

BACKGROUND OF THE INVENTION

The present invention relates to radio frequency (RF) or microwave switching, and more particularly to a high isolation RF switch to provide for dual launch of RF signals into a slabline transmission line structure.

Previously an RF slabline transmission line structure had a single input port and a single output port with a slabline transmission line between them for coupling an RF signal from the input port to the output port. In order to provide for dual launch of RF signals into the slabline transmission line structure, a pair of input ports and an appropriate switch are required to couple a selected one of the RF signals to the output port via the slabline transmission line. A separate component, usually a coaxial switch external to the slabline transmission line structure, may be used as the appropriate switch. Using an external component adds size, weight and cost as well as insertion loss due to the necessary connectors and cabling. Such coaxial switches generally are a make or break architecture where one input port is left as an open circuit when the other input port is coupled to the output port via the slabline transmission line. Whether the coaxial switch is external or integrated with the slabline transmission line structure, the open circuit of the non-selected input port acts as a radiator with the other input port acting as an antenna to receive the RF signal from the non-selected input port, i.e., some of the RF signal from the non-selected input port is coupled to the RF signal from the selected input port. FIG. 1 illustrates a poor isolation characteristic S21 between the input ports in this dual launch make/break switching configuration, being as small as 3 dB at 14 GHz. Ideally there should be a large amount of isolation between the input ports.

What is desired is a high isolation RF switch for launching a selected one of two distinct RF signals into a slabline transmission line structure.

BRIEF SUMMARY OF THE INVENTION

Accordingly the present invention provides a high isolation RF switch for launching a selected one of two distinct RF signals into a slabline transmission line structure, the high isolation RF switch being integral with the slabline transmission line structure to minimize insertion loss. The slabline transmission line structure has a slabline transmission line coupled to an output port and a pair of input ports to which the distinct RF signals are coupled. The high isolation RF switch couples a selected one of the input ports to the slabline transmission line for transmission to the output port. The high isolation RF switch has a three switch configuration—a pair of input switches coupled to the input ports and a transition switch coupled to the slabline transmission line. The input switches select one of the input ports for coupling to the transition switch, and the transition switch couples the selected input port from the input switches to the slabline transmission line. A grounded conductor is situated between the input ports in a cavity of a housing within which the high isolation RF switch is located to provide isolation between the input ports. The grounded conductor may be integral with the housing. Additional isolation between the input ports is provided by coupling the non-selected input to ground, either by grounding the non-selected input at the transition switch or the non-selected input port itself. The grounding may be to either the grounded conductor or to the housing.

The objects, advantages and other novel features of the present invention are apparent from the following detailed description when read in conjunction with the appended claims and attached drawing.

DETAILED DESCRIPTION OF THE INVENTION

Figure 1:
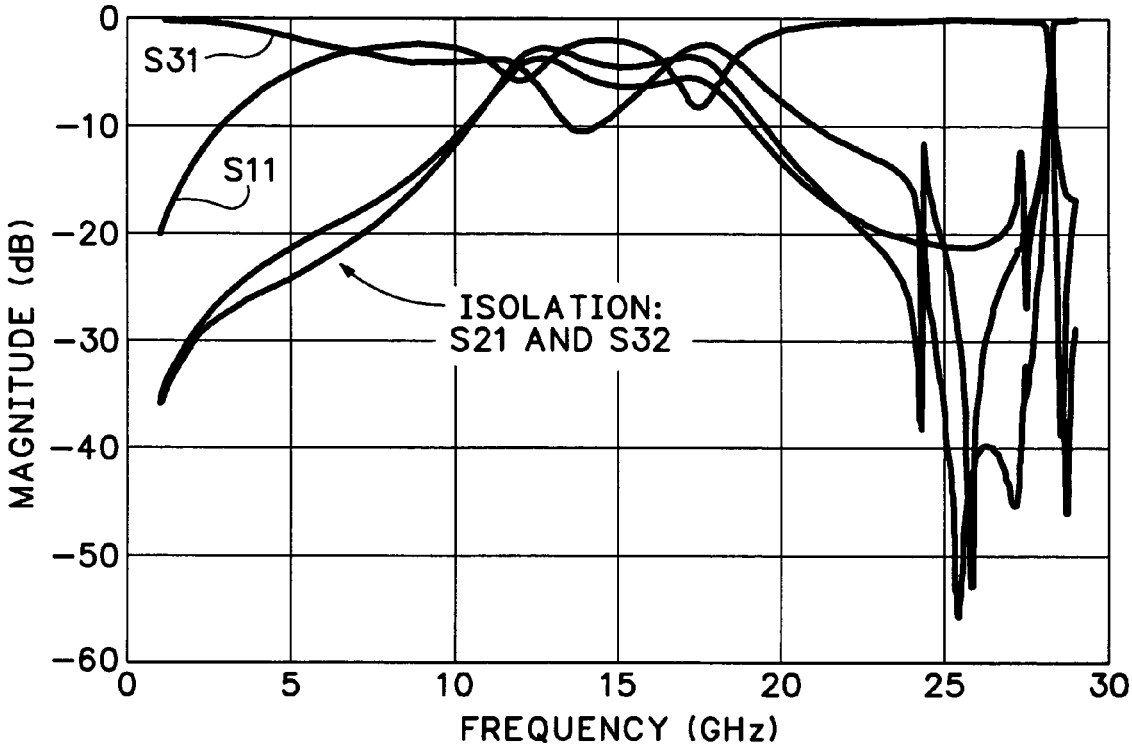
FIG.1 (PRIOR ART)
FIG. 1 is a graphic view of an isolation characteristic between input ports of a make/break coaxial switch according to the prior art.
Figure 2:
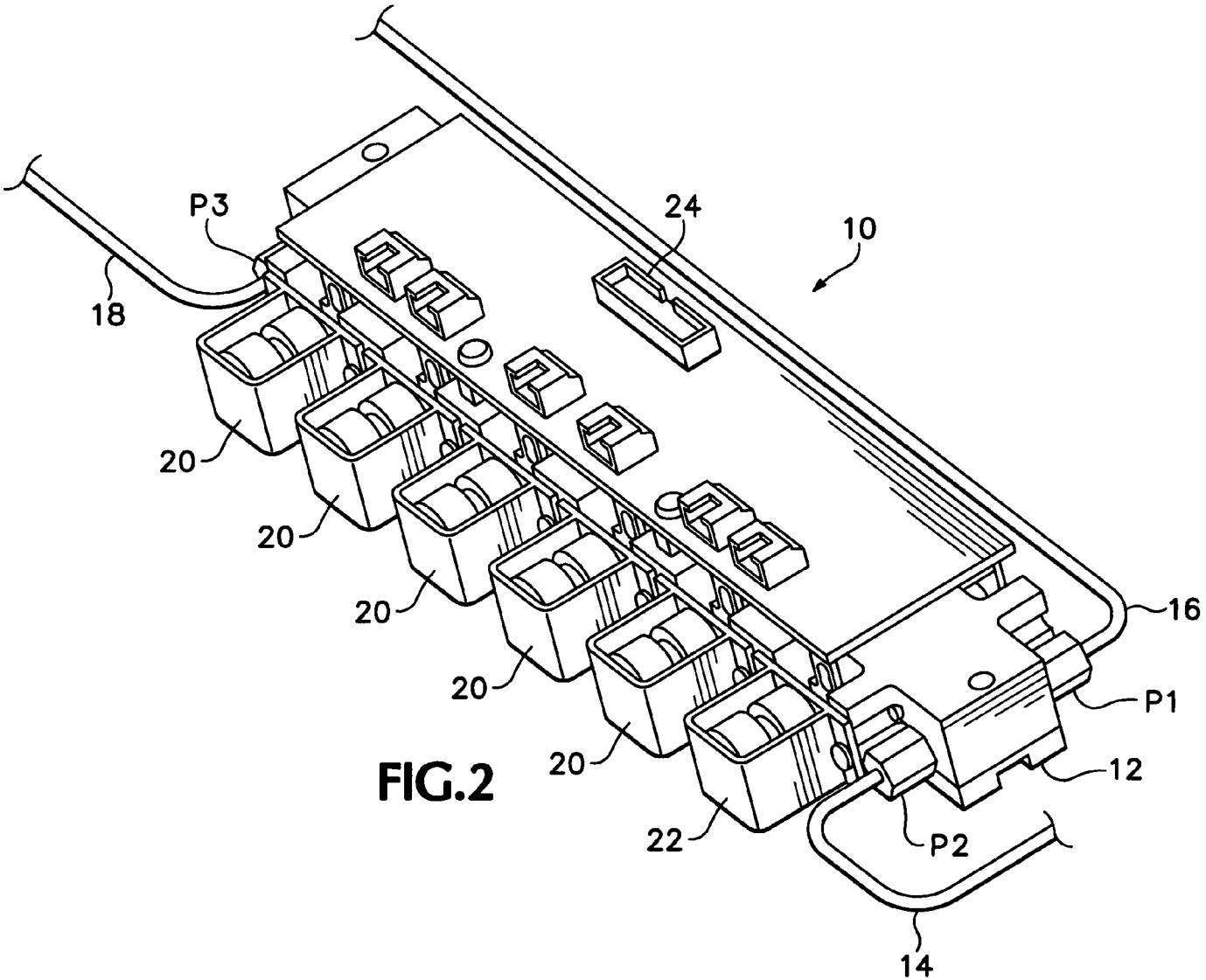
FIG. 2 is a perspective view of a slabline transmission line structure with an integral high isolation RF switch according to the present invention.

Referring now to FIG. 2 a slabline transmission line structure 10 is shown with an integral high isolation RF switch 12. The high isolation RF switch 12 has a pair of input ports P1, P2 to which respective coaxial conductors 14, 16 are connected to provide dual launch of different RF signals into the slabline transmission line structure 10. The output from the slabline transmission line structure 10 is taken from an output port P3 to which is connected an output coaxial conductor 18. A slabline transmission line is coupled between the output of the high isolation RF switch 12 and the output port P3. In this example a plurality of push/pull solenoids 20 are shown as part of an attenuator portion of the slabline transmission line structure 10, as well as a similar solenoid 22 for the high isolation RF switch 12. An appropriate electrical connector 24 on the slabline transmission line structure 10 provides for selective application of electrical power to the solenoids 20, 22.

Figure 3:
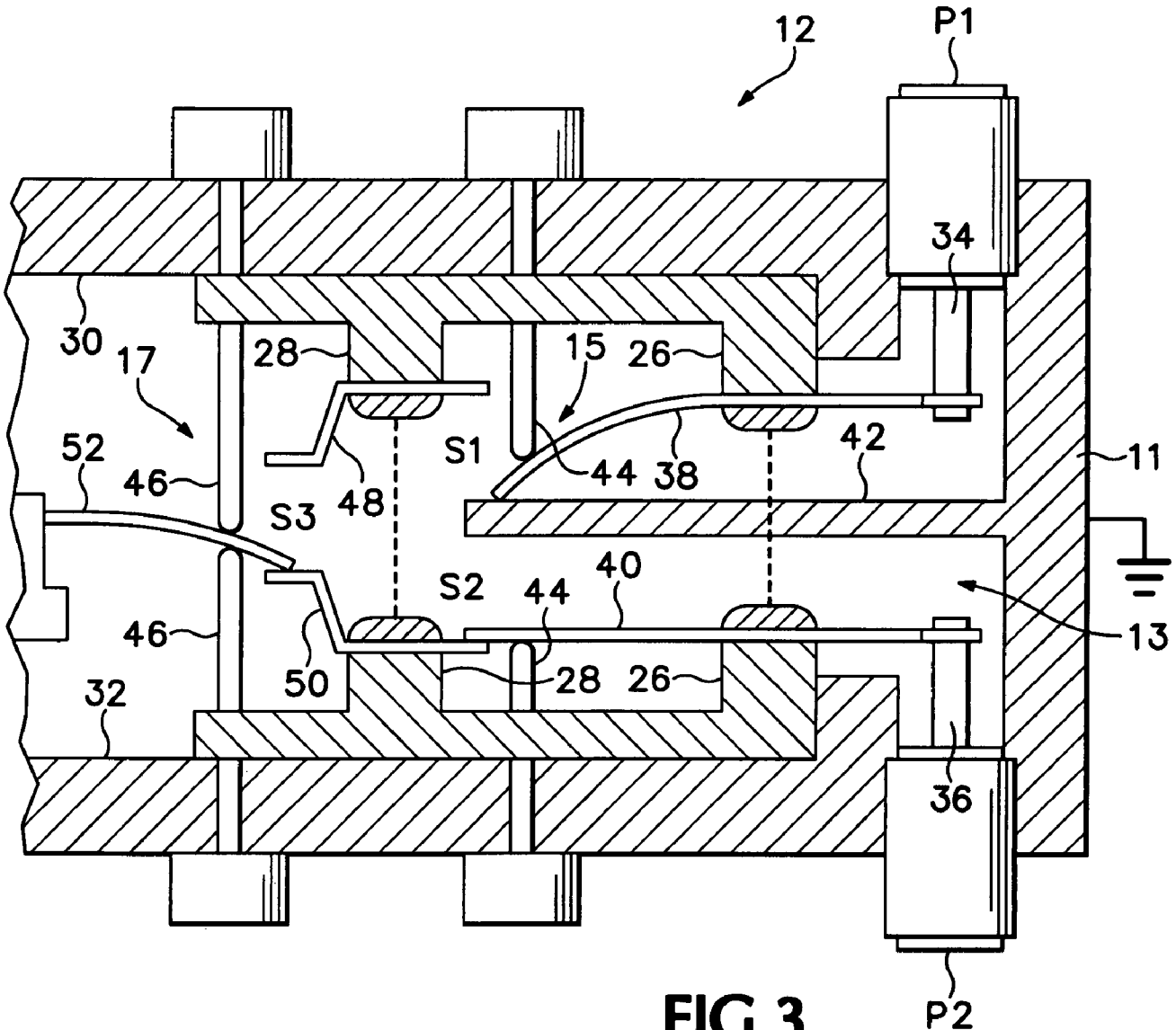
FIGS. 3 and 4 are cut-away partial views of the high isolation RF switch according to the present invention.
Figure 4:
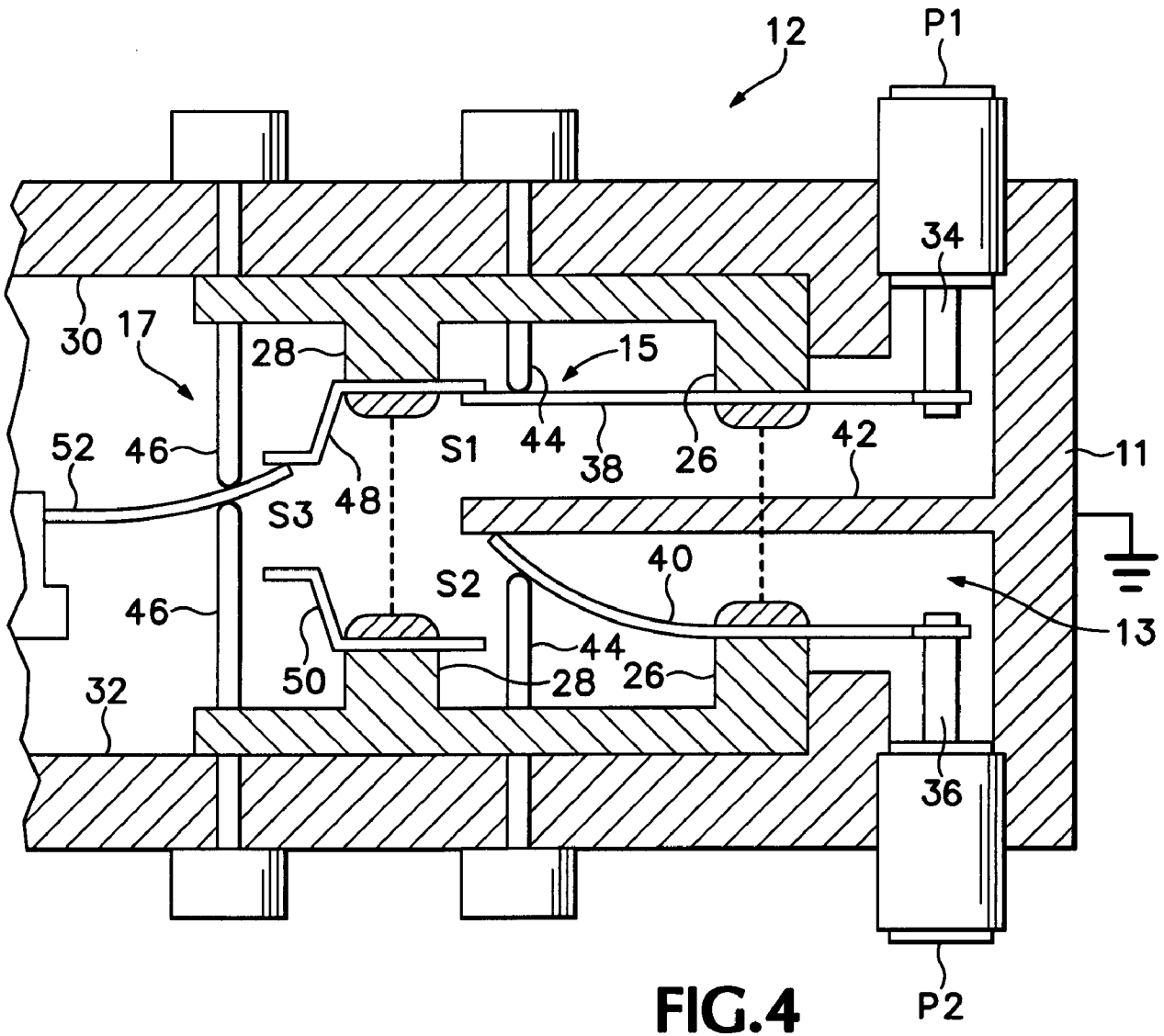
Figure 5:
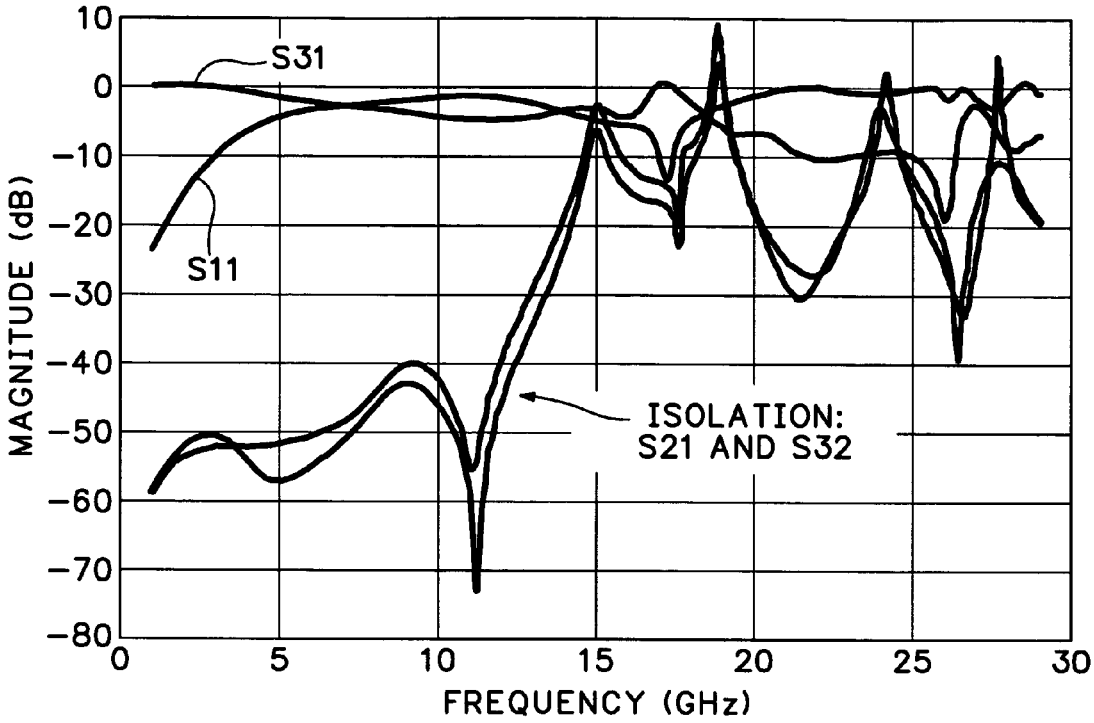
FIG. 5 is a graphic view of an isolation characteristic for a grounded conductor in the high isolation RF switch according to the present invention.

In FIGS. 3 and 4 partial cut-a-way views of the high isolation RF switch 12 show symmetric first and second support posts 26, 28 extending from opposing walls 30,32. Respective coaxial conductors 34, 36 extend from the input ports P1, P2 into a first portion (coax launch region) 13 of a cavity within a housing 11 of the high isolation RF switch 12. Coupled to the respective coaxial conductors 34, 36 and secured by the first support posts 26 are respective flexible slablines 38, 40. The flexible slablines 38, 40 extend from the coaxial connectors 34, 36 into a second portion (double switch region) 15 of the cavity in a cantilever fashion. A grounded conductor 42 extends from the housing 11 through the first and second portions 13, 15 of the cavity to provide isolation between the input ports P1, P2. As shown in FIG. 5 the introduction of the grounded conductor 42 results in improved isolation S21 of greater than 40 dB up to 12 GHz.

Symmetric first and second solenoid push pins 44, 46 are positioned to deflect the cantilevered ends of the flexible slablines 38, 40 to make contact alternately with the grounded conductor 42, i.e., only one of the flexible slablines is grounded at a time. In FIG. 3 the upper first solenoid push pin 44 has deflected the end of the upper flexible slabline 38 to contact the grounded conductor 42, and in FIG. 4 the lower first solenoid push pin has deflected the end of the lower flexible slabline 40 to contact the grounded conductor.

Respective rigid slablines 48, 50 are secured in the second support posts 28 in a third portion (transition region) 17 of the cavity, the rigid slablines having a first end extending into the second portion 15 of the cavity on one side of the post and a second end extending into the third portion of the cavity. The second ends of the rigid slablines 48, 50 preferably are bent to lessen the gap between them. In a first select position, as shown in FIG. 3, the lower flexible slabline 40 contacts one of the rigid slablines 50 to select input port P2 and in a second select position, as shown in FIG. 4, the upper flexible slabline 38 contacts the other of the rigid slablines 48 to select input port P1. The first switch S1 in the second portion 15 of the cavity is formed by the cantilever end of the upper flexible slabline 38 moving between one end of one rigid slabline 48 and the ground conductor 42, and the second switch S2 is formed by the cantilever end of the lower flexible slabline 40 moving between one end of the other rigid slabline 50 and the ground conductor.

Figure 6:
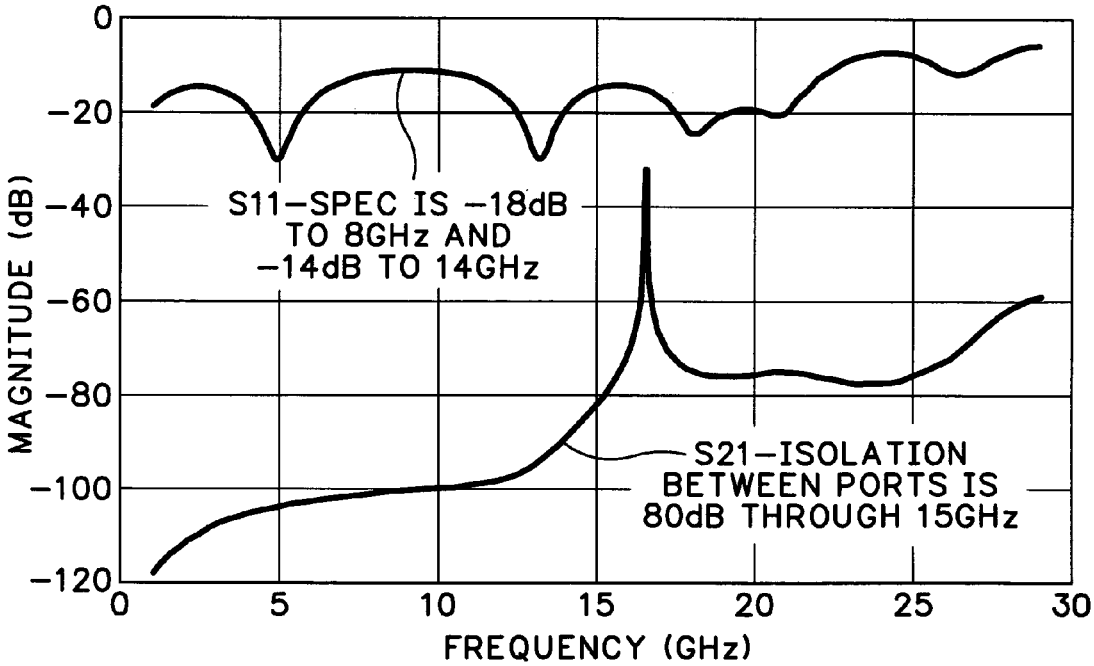
FIG. 6 is a graphic view of an isolation characteristic when the non-selected input port is grounded in the high isolation RF switch according to the present invention.

A third switch S3 is formed by the adjoining ends of the rigid slablines 48, 50 in the third portion 17 of the cavity and a cantilevered end of the slabline transmission line 52 that extends from the transmission slabline structure 10, the slabline transmission line being coupled to the output port P3. The second push pins 46 move the cantilevered end of the slabline transmission line 52 alternately between the ends of the rigid slablines 48, 50. FIG. 3 shows the configuration for an RF signal from port P2 being passed to the slabline transmission line 52 via switches S2, S3, with port P1 being grounded to the grounded conductor 42 by switch S1. FIG. 4 shows the configuration for a signal from port P1 being passed to the slabline transmission line 52 via switches S1, S3, with port P2 being grounded to the grounded conductor 42 by switch S2. The resulting isolation with the non-selected input port grounded is shown in FIG. 6 where the isolation between ports P1 and P2 is 100 dB up to 10 Ghz and 80 dB up to 15 GHz.

Figure 7:
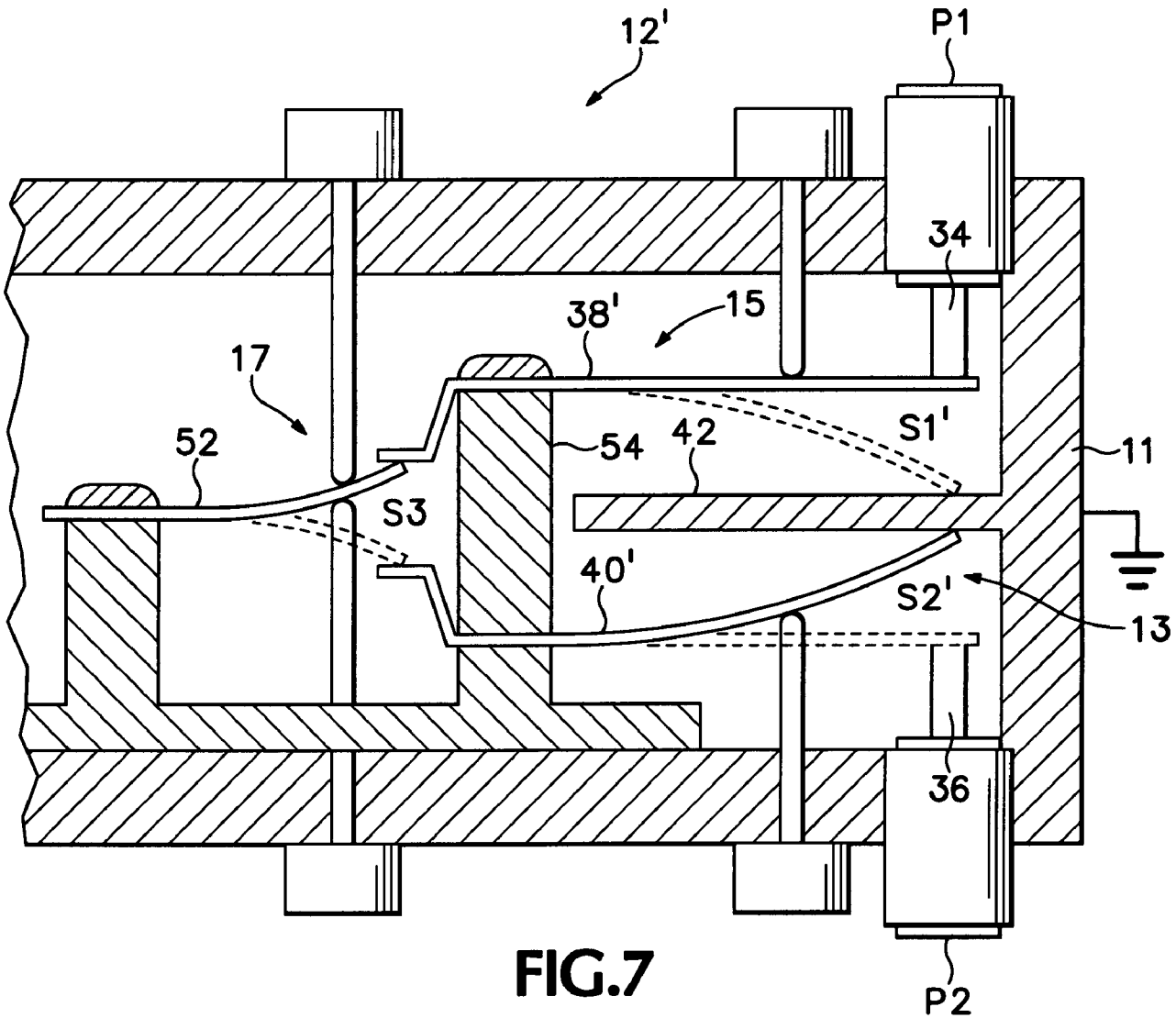
FIGS. 7 and 8 are cut-away partial views of alternative embodiments of the high isolation RF switch according to the present invention.
Figure 8:
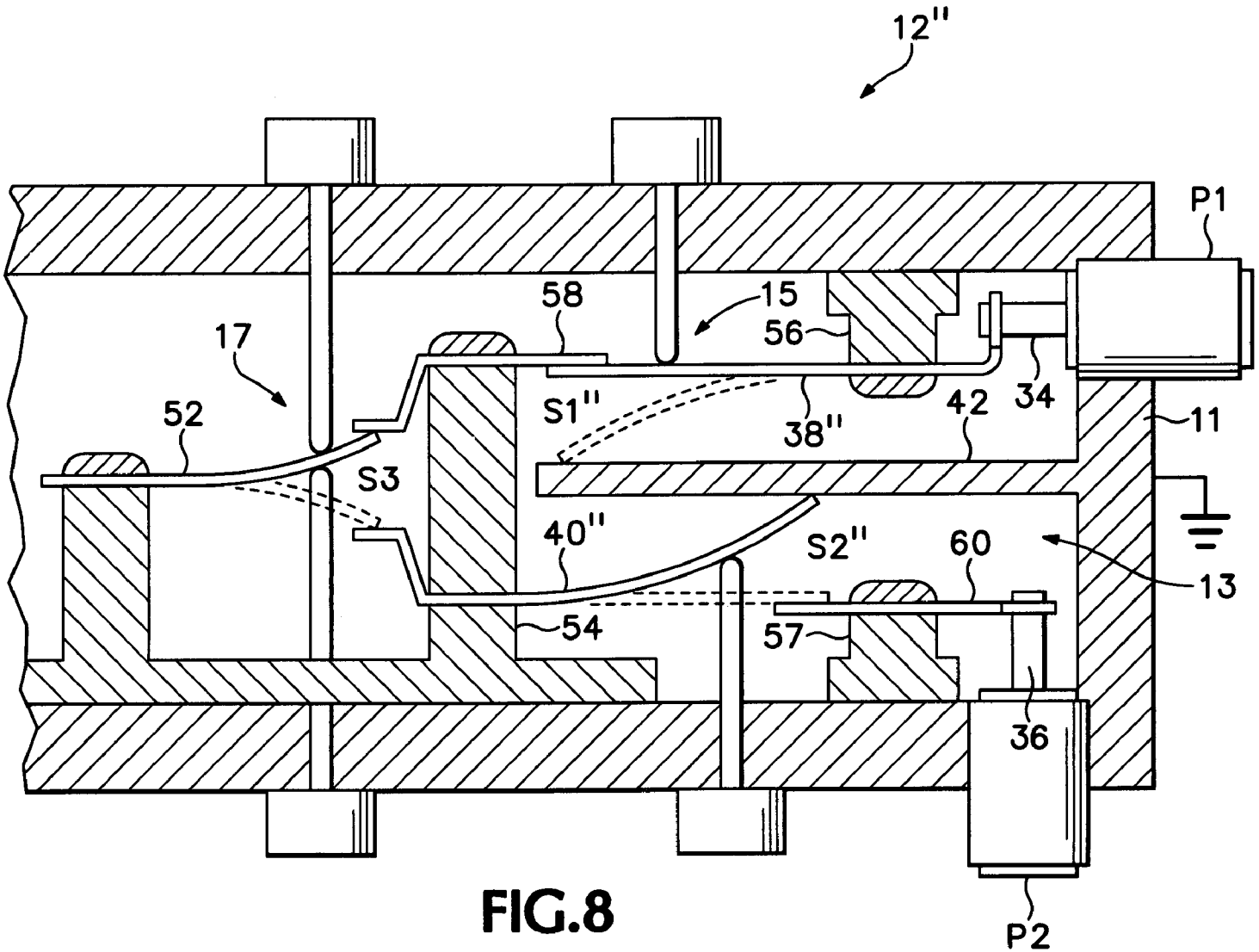

As shown in FIGS. 7 and 8 there are other structures that produce similar results. In each case the non-selected input to the output switch S3' from the input ports P1,P2 is coupled to the grounded conductor 42, although alternatively the non-selected input also may be grounded to the housing. The dotted lines show the alternate signal paths from the opposing input ports. The solenoid pins may operate in a push/pull configuration as opposed to just a push configuration, or a combination thereof.

In FIG. 7 switches S1', S2' are operated in a push/pull configuration. The first flexible slablines 38', 40' are mounted on a central post 54 so that the cantilevered ends extend into the coax launch portion 13 of the cavity of the RF switch 12' and move between the grounded conductor 42 and the respective coaxial conductors 34, 36. Switch S3 is the same as that in FIGS. 3 and 4.

In FIG. 8 switch S1' is a push pin switch with the upper flexible slabline 38" being coupled to the coaxial connector 34 and being secured in a support post 56 near input port P1, extending cantilever fashion into the double switch portion 15 of the cavity. The center support post 54 in this instance has a rigid upper slabline 58 so that the cantilever end of the upper flexible slabline 38" contacts either the grounded conductor 42 or the upper rigid slabline 58 as part of the switch S1". Another input support post 57 is adjacent the other input port P2 and an input rigid slabline 60, secured in the input support post, is coupled to the coaxial connector 36. As in FIG. 7 the lower flexible slabline 40" is secured to the center support post 54 and extends cantilever fashion into the coax launch portion 13 of the cavity so that the cantilevered end moves between the grounded conductor 42 and the rigid slabline 60 to form switch S2". In this instance, rather than grounding the coaxial conductor 36, the non-selected input to switch S3 is grounded.

Thus the present invention provides a high isolation RF switch for launching a selected one of a pair of RF signals into a slabline transmission structure, the high isolation RF switch having three switches—a pair of input switches and a transition switch—within a cavity of a housing and a grounded conductor between a pair of input ports for isolation. The RF signal from a selected input port is coupled via the switches to a slabline transmission line coupled to an output port while the non-selected input port or the non-selected input to the transition switch is grounded for additional isolation.

What is claimed is:

1. A high isolation RF switch comprising:

a transition switch having an output coupled to a slabline transmission line, a first input, a second input and means for coupling either the first or second input to the output;

a first input switch having an output coupled to the first input of the transition switch, a first RF input and means for coupling a first RF input port to the first RF input and for decoupling the first RF input port from the first RF input;

a second input switch having an output coupled to the second input of the transition switch, a second RF input and means for coupling a second RF input port to the second RF input and for decoupling the second RF input port from the second RF input;

a grounded conductor situated between the first and second RF input ports to provide isolation; and means for controlling the transition, first input and second input switches such that one of the first and second RF input ports is coupled to the slabline transmission line and the other of the first and second RF input ports is decoupled from the slabline transmission line.

2. The high isolation RF switch as recited in claim 1 wherein each of the first and second input switches comprises a flexible slabline coupled to the RF input port and having a cantilever end capable of being deflected from a select position where the transition switch is coupled to the RF input port to a non-select position where the transition switch is decoupled from the RF input port.

3. The high isolation RF switch as recited in claim 2 wherein in the non-select position the cantilever end is coupled to the grounded conductor.

4. The high isolation RF switch as recited in claim 1 wherein each of the first and second input switches comprises a flexible slabline coupled to a center support post having a rigid end for coupling to the transition switch and having a cantilever end capable of being deflected between a select position where the RF input port is coupled to the transition switch and a non-select position where the RF input port is decoupled from the transition switch.

5. The high isolation RF switch as recited in claim 4 wherein in the non-select position the cantilever end is coupled to the grounded conductor.

6. The high isolation RF switch as recited in claim 1 wherein the first input switch comprises a first flexible slabline coupled to the first RF input port having a cantilever end capable of being deflected from a select position coupling the first RF input port to the transition switch to a non-select position decoupling the first RF input port from the transition switch; and wherein the second input switch comprises a second flexible slabline coupled to a center support post having a rigid end for coupling to the transition switch and a cantilever end capable of being deflected between a select position for coupling the second RF input port to the transition switch and a non-select position for decoupling the second RF input port from the transition switch.

7. The high isolation RF switch as recited in claim 6 wherein in the non-select position the cantilever ends are coupled to the grounded conductor.

8. The high isolation RF switch as recited in any of claims 1–7 wherein the transition switch comprises a cantilever end of the slabline transmission line capable of being deflected between the first and second inputs.

9. The high isolation RF switch as recited in any of claims 2, 4 or 6 wherein in the non-select position the cantilever ends are coupled to a housing enclosing the high isolation RF switch.

* * * * *